US005522622A

United States Patent [19]

Segar

[11] Patent Number: 5,522,622

[45] Date of Patent: Jun. 4, 1996

[54] GREETING CARDS AND METHOD FOR DISPLAYING SAME

[76] Inventor: Betty Segar, 6212 Windlass Cir., Boynton Beach, Fla. 33437

[21] Appl. No.: 356,442

[22] Filed: Dec. 13, 1994

[51] Int. Cl.[6] ..... B42D 15/00

[52] U.S. Cl. ..... 283/62; 283/61; 283/117; 283/67

[58] Field of Search ..... 283/117, 67, 61, 283/62; 40/124.1

[56] References Cited

U.S. PATENT DOCUMENTS

| | | | |
|---|---|---|---|
| 3,986,283 | 10/1976 | Pelaez . | |
| 4,104,816 | 8/1978 | Pingeton . | |
| 4,200,222 | 4/1980 | Feuer . | |
| 4,439,941 | 4/1984 | Halperin . | |
| 4,484,768 | 11/1984 | Norfleet . | |
| 4,688,826 | 8/1987 | Hosoya | 283/79 |
| 4,741,119 | 5/1988 | Baryla . | |
| 4,763,427 | 8/1988 | Schrager . | |
| 4,826,211 | 5/1989 | Sinnott et al. . | |
| 4,864,755 | 9/1989 | Owens . | |
| 4,951,404 | 8/1990 | Lithwick . | |
| 4,951,969 | 8/1990 | Epstein et al. . | |
| 4,952,091 | 8/1990 | Sirko . | |
| 5,102,171 | 4/1992 | Saetre . | |
| 5,190,316 | 3/1993 | Hefty | 283/117 X |
| 5,240,287 | 8/1993 | Nirmel . | |
| 5,261,174 | 11/1993 | Blegen . | |
| 5,284,365 | 2/1994 | Stuart . | |
| 5,318,327 | 6/1994 | Daneshvar | 283/117 |
| 5,318,825 | 6/1994 | Naber . | |

*Primary Examiner*—Willmon Fridie, Jr.
*Attorney, Agent, or Firm*—Quarles & Brady

[57] ABSTRACT

A greeting card is disclosed which can be displayed from upright surfaces such as walls, doors, windows, furniture, and the like. The greeting card has an adhesive on an exterior surface of the back panel of the greeting card. A movable cover is positioned over the adhesive. The cover can be moved when it is desired to attach the card to the surface, and the card is pressed against the surface so as to contact the adhesive to the surface. The adhesive will hold the card against the surface where the exterior surface of the front panel can be viewed, and where the interior of the card can also be viewed by prying open the front panel. A method for attaching greeting cards to surfaces is also disclosed.

9 Claims, 3 Drawing Sheets

GREETING CARDS AND METHOD FOR DISPLAYING SAME

BACKGROUND OF THE INVENTION

This invention relates generally to greeting cards, and more particularly to structure and apparatus for displaying greeting cards.

DESCRIPTION OF THE RELEVANT ART

Recipients of greeting cards frequently wish to display these cards. This is particularly so during holidays or during stays in nursing homes or hospitals. The cards are opened and placed upright and edgewise on a flat surface so that the cover, and perhaps the interior contents, of the card can be seen by the recipient and other viewers. This requires a significant amount of space and the cards are easily knocked over. It is therefore desirable to place the cards on a wall, door, or other vertical surface so that the cards do not take up as much space, are not knocked over, and can be more easily seen. This usually requires the use of tacks, which sometimes fall out and, in any event, leave holes in the wall or door. An alternative is to use tape, such as masking tape or clear plastic tape, to attach the card to the vertical surface. This requires that the recipient have tape at hand, and the use of the tape is time consuming and inconvenient.

It would be desirable to provide a convenient method for displaying greeting cards, particularly on vertical surfaces. It would further be desirable that such method be useful with cards of different shapes, sizes and construction.

SUMMARY OF THE INVENTION

It is an object of the invention to provide a method and apparatus for displaying greeting cards.

It is another object of the invention to provide a method and apparatus for displaying greeting cards on upright surfaces.

It is still another object of the invention to provide a method and apparatus for displaying greeting cards which can be used with cards having different sizes, shapes and construction.

These and other objects are accomplished by a greeting card having at least front and back panels and at least one fold therebetween. Each panel has exterior and interior surfaces, the interior surfaces substantially facing one another when the card is closed. An adhesive is provided at the exterior surface of the back panel. The exterior surface of the back panel can be pressed against the upright surface, causing the adhesive to contact that surface. The greeting card will thereby be displayed on the upright surface. The front panel can be manipulated so as to more effectively display either the exterior suface of the front panel or the interior contents of the card.

The adhesive is covered when it is not in use. This will prevent the adhesive from causing cards to adhere together during shipping, or to adhere to surfaces when such is not desired.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
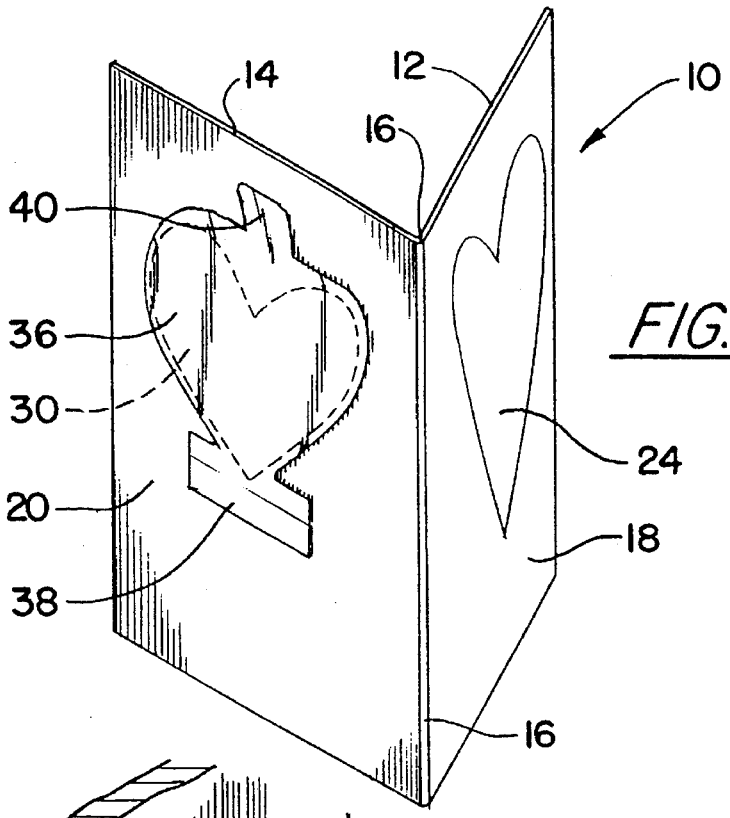
FIG. 1 is a perspective view of a greeting card according to the invention.
Figure 2:
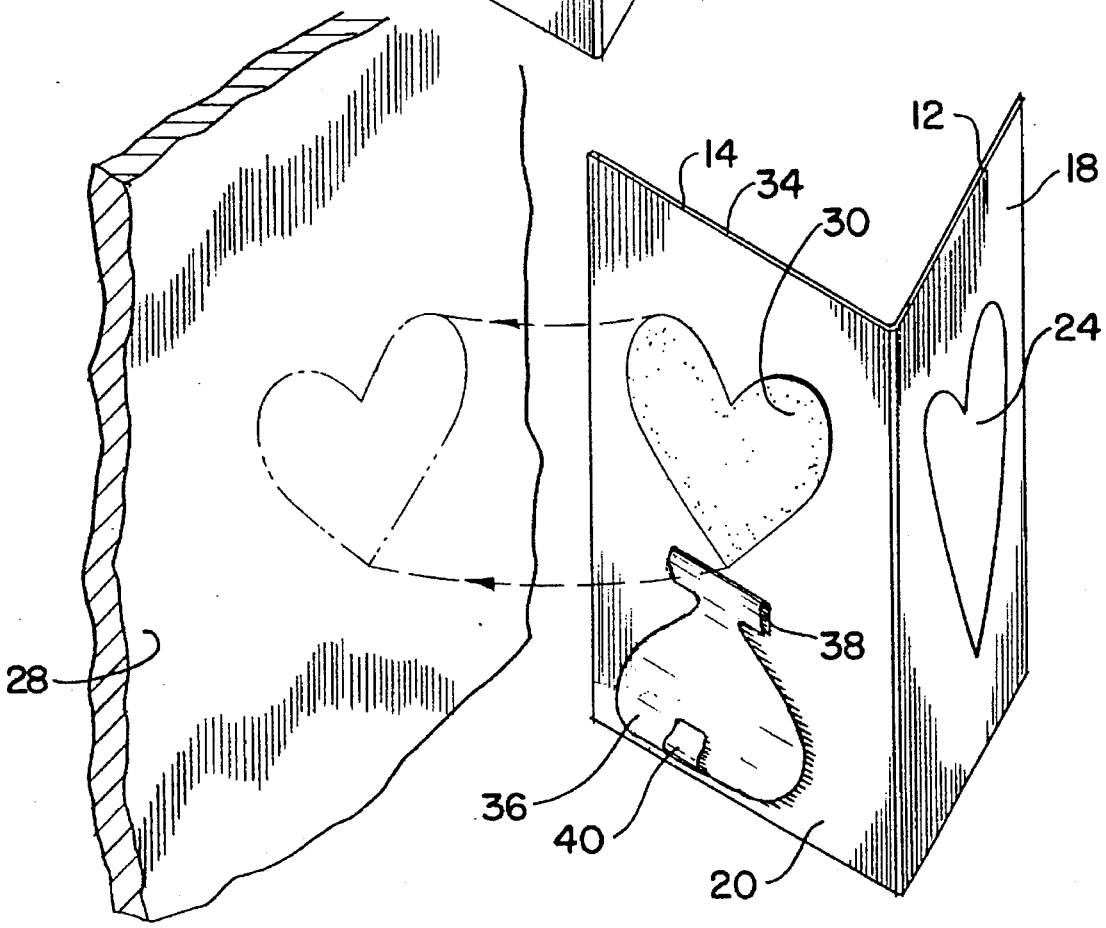
FIG. 2 is a perspective view, partially broken away, illustrating the manner of attachment of the greeting card to an upright surface.

A greeting card 10 according to the invention is shown in FIGS. 1–2, and generally includes a front panel 12 and a back panel 14 separated by a fold 16. The front panel 12 has an exterior surface 18 and an interior surface on the opposite side thereof. The back panel 14 has an exterior surface 20 and an interior surface on the opposite side thereof. The greeting card will typically have printed indicia 24 on the exterior surface 18 of the front panel 12 which, along with the interior contents of the card 10, is to be displayed to the viewer on an upright surface 28. The upright surface 28 can be a wall, door, refrigerator, window, or virtually any other upright surface capable of displaying a greeting card.

The card 10 has an adhesive 30 on the exterior surface 20 of the back panel 14. The adhesive 30 is preferably positioned at least at the center or top portion of the back panel 14, such that the card will hang properly when adhered to the upright surface 28. The adhesive can be applied during the manufacturing process in virtually any shape, including decorative shapes such as the heart 34 that is shown. The adhesive can additionally or alternatively be positioned at one or more of the corners of a panel.

The adhesive 30 is a mild adhesive which will permit the removal or repositioning of the card 10 from the surface 28 without also removing wallpaper, paint, or the like. Also, the removal of the card 10 should not leave adhesive or stains of any kind on the surface 28. Suitable adhesives are known, and include adhesives that are sticky, tacky, and non-hardening. A cover 36 can be positioned over the adhesive 30 when it is not intended to use the adhesive. The cover 36 will prevent the adhesive from sticking undesirably to other surfaces, and to other greeting cards during shipping and display on store racks. The cover 36 can be formed from suitable non-stick materials such as a thin plastic film. The cover material should gently adhere to the adhesive, but should be readily removable when use of the adhesive is desired. The cover 36 will generally be in the shape of the adhesive 30 such as the heart 34, but need not identically match this shape so long as the cover 36 fully covers the adhesive 30.

It is desirable that at least a portion of the cover 36, as at the base 38, be permanently attached to the greeting card so that the cover will not become litter upon removal, and also so that the cover 36 will be available for replacement over the adhesive 30 when the card is removed from the upright surface. A tab portion 40 can be provided with the cover 36. The tab portion 40 does not cover the adhesive 30 and is used to grasp the cover 36 to peel the cover from the adhesive 30.

In use, the cover 36 is first removed from the the position over the adhesive 30. The adhesive 30 is then pressed against the surface 28 by placing the card 10 against the surface 28 and pressing gently. The adhesive will adhere the card 10 to the surface 28 to display the card 10. The viewer can gently pry open the front panel 12 to permit viewing the interior contents of the card 10.

Upon removal of the card 10 from the surface 28, the cover 36 can be replaced over the adhesive 30 so that the card 10 can be stored away, as in a drawer or box, without adhering undesirably to other cards or objects.

Figure 3:
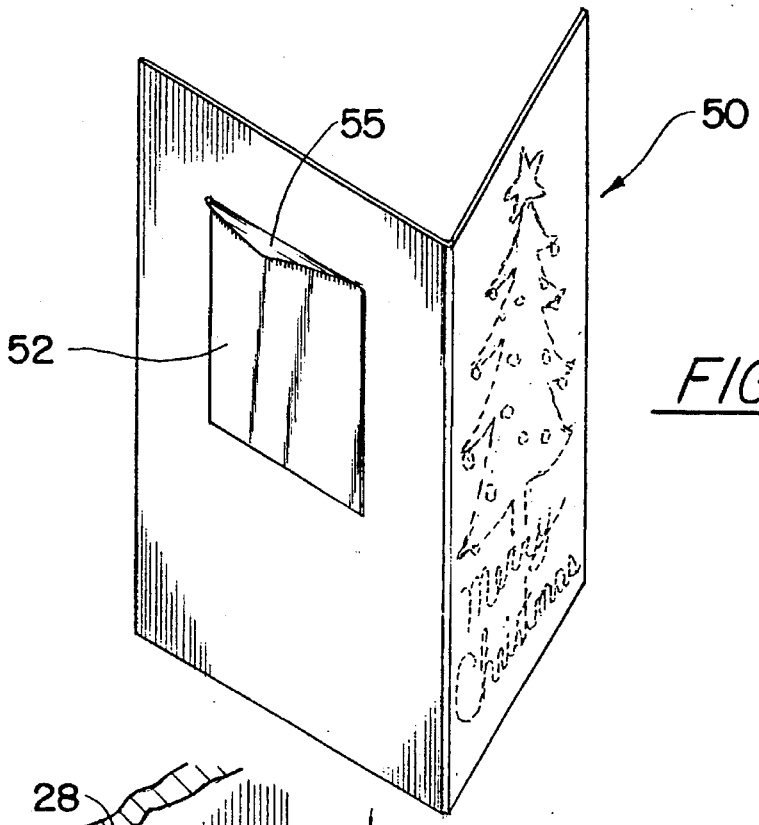
FIG. 3 is a perspective view of an alternative embodiment of the invention.
Figure 4:
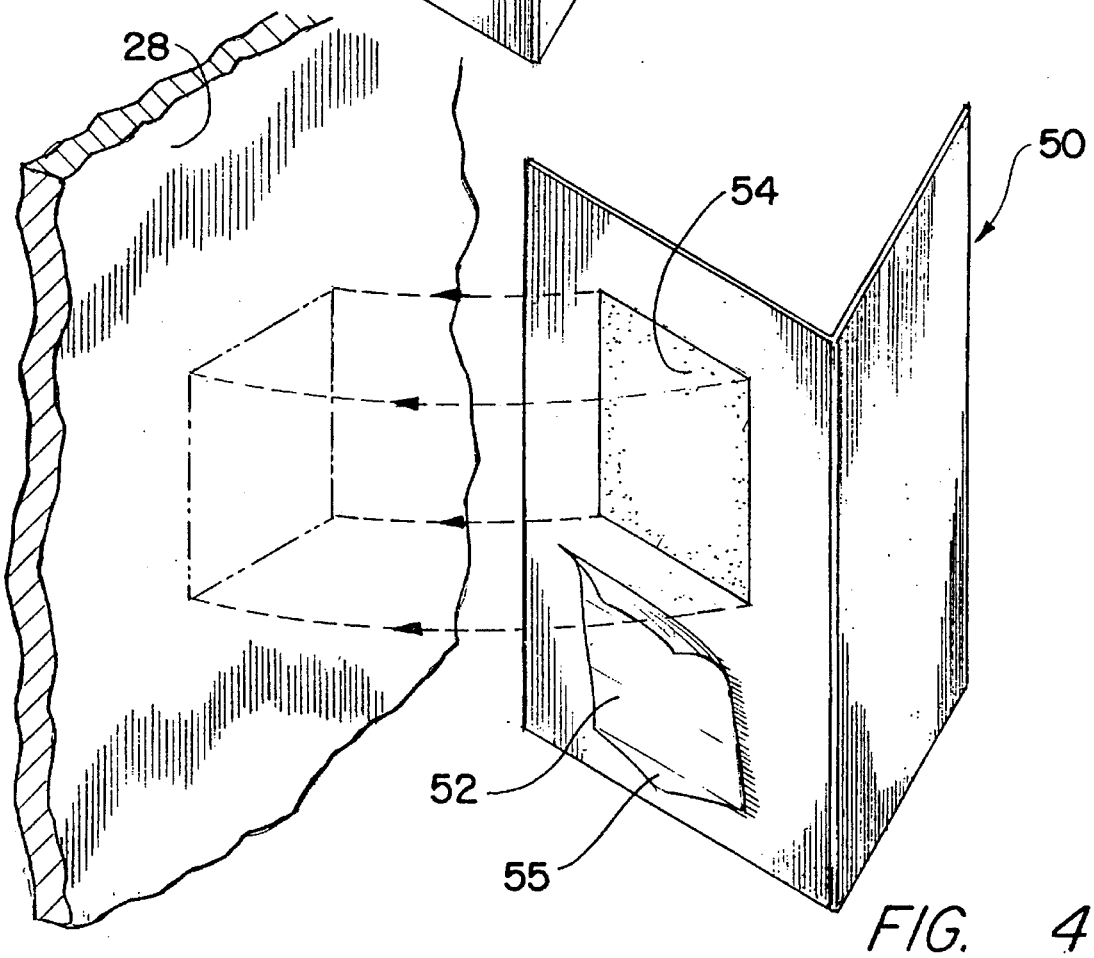
FIG. 4 is a perspective view, partially broken away, illustrating the manner of attachment of the greeting card of FIG. 3 to an upright surface.

The cover 36 need not be permanently attached to the card 10. In this instance, the cover 36 is completely removed from the card 10 when the adhesive 30 is to be used, and either discarded or placed aside until the cover 36 is to be re-used to cover the adhesive 30. Such a card 50 is shown in FIGS. 3–4. The cover 52 is completely removed from the adhesive 54 prior to placement of the card 50 against the vertical surface 28. A tab 55 as previously described can also be provided.

Figure 5:
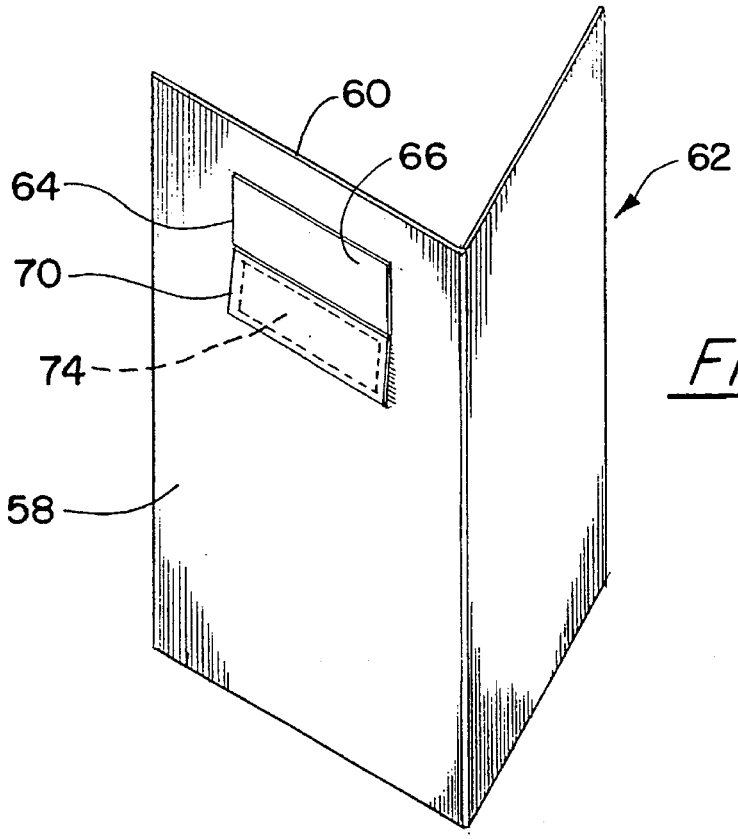
FIG. 5 is a perspective view of a third embodiment of the invention, in a first mode of use.
Figure 6:
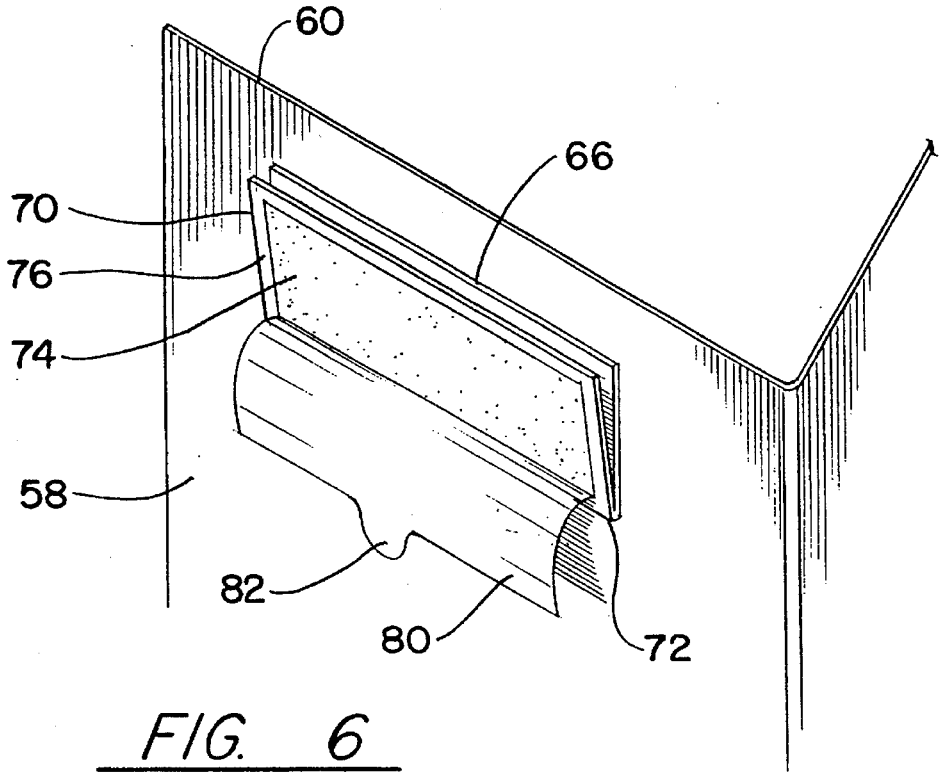
FIG. 6 is a perspective view of the greeting card of FIG. 5, as configured to attach the card to an upright surface.

An alternative embodiment is shown in FIGS. 5–6. In this embodiment, the adhesive is not placed directly on the exterior surface 58 of the back panel 60 of the card 62. An attachment member 64, which can be made of cardboard, plastic, plastic film and tape, or the like, is permanently adhered to the exterior surface 58 of the back panel 60. Preferably, only a portion, such as the top portion 66, is permanently adhered to the card. A bottom portion 70 can be moved away from the card and folded upward against the top portion 66 (FIG. 6). A fold line 72 can be provided for this purpose if the attachment member 64 is made from a stiff material.

An adhesive 74 is provided on a surface 76 of the bottom portion 70 which faces away from the exterior surface 58 when the bottom portion 70 is in the folded position as shown in FIG. 6. A cover 80 can be used to shield the adhesive 74 from contact when not in use. The cover 80 can be permanently attached to the bottom portion 70 along the lower edge thereof (as shown) or can be completely removable from the bottom portion 70. A tab portion 82 can be used as described above to facilitate the removal and replacement of the cover 80 over the adhesive 74.

In use, when it is desired to display the card 62, the lower bottom portion 70 is folded upward to the position of FIG. 6. The cover 80 is then removed from its position over the adhesive 74. The card is then pressed against the vertical surface such that the adhesive 74 will engage the surface and hold the card in place. The bottom portion 70 therefore acts as an adhesive hanger for the card. The card can be removed from the surface when desired and the cover 80 can be replaced over the adhesive 74. The bottom portion 76 can be folded back downward against the exterior surface 58 of the back panel 60 to the initial position shown in FIG. 5. In this manner, the card can be stored in a drawer or stacked against other cards without the bottom portion 70 taking unnecessary space and adhering to adjacent objects.

The cover 80 is not strictly necessary. It will be noted that if the cover 80 is not provided, or if it is permanently removed, the bottom portion 76 will be adhered against the exterior surface 58 of the card 62 by the adhesive 74. The adhesive 74 will be covered and the card will not adhere to other cards or adjacent objects. This will also be the case when the bottom portion 74 is folded down after use and the attachment member is flat against the exterior surface of the card 62.

The invention is suitable for use with greeting cards of various sizes, materials, and constructions. It is also possible to use the invention with multi-panel "accordion" type greeting cards, or large or heavy greeting cards, by the provision of more than one adhesive portion. Further alternatives and other embodiments of the invention will be apparent to those having skill in the art, and accordingly, reference should be had to the following claims, rather than to the foregoing specification, as indicating the scope of the invention.

I claim:

1. A greeting card having at least front and back panels, and a fold therebetween, said front and back panels having interior and exterior surface;

an adhesive operatively connected to the exterior surface of the back panel, said adhesive having an adhesive strength sufficient to support the weight of the entire greeting card; and a cover over the adhesive, said cover being movable to expose the adhesive, whereby the adhesive can be pressed against an upright surface to adhere the greeting card to the surface.

2. The greeting card of claim 1, wherein said cover is removable from the greeting card.

3. A greeting card having at least front and back panels, and a fold therebetween, said front and back panels having interior and exterior surfaces;

an adhesive operatively connected to the exterior surface of the back panel; and a cover over the adhesive, said cover being movable to expose the adhesive, a portion of said cover being permanently adhered to said greeting card, whereby the adhesive can be pressed against an upright surface to adhere the greeting card to the surface, and whereby said cover can be folded away from said adhesive during use and pulled over the adhesive when the adhesive is no longer in use.

4. The greeting card of claim 1, wherein said cover comprises a pull-tab portion which does not contact the adhesive when the cover is in place over the adhesive.

5. The greeting card of claim 1, wherein the adhesive is applied to the card in a decorative shape, and the cover is provided in a substantially matching shape.

6. A greeting card having at least front and back panels, and a fold therebetween, said front and back panels having interior and exterior surfaces;

an adhesive operatively connected to the exterior surface of the back panel; and a cover over the adhesive, said cover being movable to expose the adhesive, the adhesive being provided on an attachment member, the attachment member being attached to the exterior surface of the back panel of the greeting card, whereby the adhesive can be pressed against an upright surface to adhere the greeting card to the surface.

7. The greeting card of claim 6, wherein said attachment member comprises a top portion and a bottom portion, the top portion being permanently adhered to the exterior surface of the back panel, the bottom portion being foldable, an adhesive being provided on a surface of the bottom portion which faces outward from the exterior surface of the back panel when in the folded position.

8. A greeting card comprising:

front and back panels joined by a fold line, each panel having interior and exterior surfaces;

an attachment member having a portion that is permanently attached to the exterior surface of the back panel, and having a free portion than is not so attached, the free portion having an adhesive, the adhesive releasably adhering the free portion against the exterior surface of the back panel, the free portion being foldable away from the exterior surface, whereby the free portion can be pressed against a surface to adhere the card to the surface, and whereby after use the free portion can be folded downward to adhere the free portion to the exterior surface of the card.

9. A method for adhering a greeting card to a surface, the greeting card having front and back panels joined by a fold line, the front and back panels having interior and exterior surfaces, said method comprising the steps of:

providing an adhesive on the exterior surface of the back panel;

providing a movable cover over the adhesive;

removing the cover from the adhesive;

pressing the card against the surface such that the adhesive will contact the surface and adhere the card to the surface.

* * * * *